US005223288A

United States Patent [19]

Mendenhall et al.

[11] Patent Number: 5,223,288

[45] Date of Patent: Jun. 29, 1993

[54] MICROWAVABLE FOOD PACKAGE AND HEAT ASSIST ACCESSORY

[75] Inventors: Abraham H. Mendenhall, Morris County, N.J.; Joseph F. Irace; Joseph Skudrzyk, both of St. Louis County, Mo.

[73] Assignee: Packaging Concepts, Inc., St. Louis, Mo.

[21] Appl. No.: 714,623

[22] Filed: Jun. 13, 1991

Related U.S. Application Data

[63] Continuation-in-part of Ser. No. 703,280, May 20, 1991.

[51] Int. Cl.[5] ..... B65D 81/34

[52] U.S. Cl. ..... 426/107; 219/10.55 E; 426/234

[58] Field of Search ..... 426/107, 113, 234, 243; 219/10.55 E

[56] References Cited

U.S. PATENT DOCUMENTS

| | | | |
|---|---|---|---|
| 4,230,924 | 10/1980 | Brastad et al. . | |
| 4,258,086 | 3/1981 | Beall . | |
| 4,267,420 | 5/1981 | Brastad . | |
| 4,553,010 | 11/1985 | Bohrer et al. . | |
| 4,555,605 | 11/1985 | Brown et al. . | |
| 4,567,341 | 1/1986 | Brown . | |
| 4,590,349 | 5/1986 | Brown et al. . | |
| 4,592,914 | 6/1986 | Kuchenbecker . | |
| 4,594,492 | 6/1986 | Maroszek . | |
| 4,596,713 | 6/1986 | Burdette | 426/107 |
| 4,612,431 | 9/1986 | Brown et al. . | |
| 4,626,641 | 12/1986 | Brown . | |
| 4,641,005 | 2/1987 | Seiferth . | |
| 4,661,671 | 4/1987 | Maroszek . | |
| 4,678,882 | 7/1987 | Bohrer et al. . | |
| 4,735,513 | 4/1988 | Watkins et al. | 426/107 |
| 4,742,203 | 5/1988 | Brown et al. . | |
| 4,775,771 | 10/1988 | Pawlowski et al. . | |
| 4,780,587 | 10/1988 | Brown . | |
| 4,794,005 | 12/1988 | Swiontek . | |
| 4,825,025 | 4/1989 | Seiferth . | |
| 4,861,958 | 8/1989 | Bohrer et al. . | |
| 4,883,936 | 11/1989 | Maynard | 219/10.55 E |
| 4,943,456 | 7/1990 | Pollart et al. | 426/107 |
| 4,970,358 | 11/1990 | Brandberg et al. | 426/107 |
| 4,982,064 | 1/1991 | Hartman et al. | 426/107 |
| 5,038,009 | 8/1991 | Babbitt | 426/243 |

FOREIGN PATENT DOCUMENTS

| | | | |
|---|---|---|---|
| WO8911772 | 11/1989 | PCT Int'l Appl. | 219/10.55 E |
| WO9107861 | 5/1991 | PCT Int'l Appl. | 219/10.55 E |

*Primary Examiner*—Steven Weinstein
*Attorney, Agent, or Firm*—Paul M. Denk

[57] ABSTRACT

A microwavable food product package comprises two separate parts: a bag in which the food is packaged, and an accessory which is placed over a face or wall of the bag. The accessory has a fully metalized surface with a pattern of metal free areas formed in the metallization. The pattern is formed to resemble the break-up or fretting of a continuous unbroken layer of metal when it is heated by microwave energy. The pattern may be formed as a plurality of rows of S's which criss-cross he accessory, or it may be a tight grid pattern of thin lines of unmetalized areas.

13 Claims, 2 Drawing Sheets

MICROWAVABLE FOOD PACKAGE AND HEAT ASSIST ACCESSORY

CROSS-REFERENCE TO RELATED APPLICATION

The subject matter of this application is related and comprises a continuation in part of the patent application having Ser. No. 07/703,280, filed on May 20, 1991, which application is owned by a common assignee.

BACKGROUND OF THE INVENTION

This invention relates to the microwavable food packages, and in particular, to a manner of applying microwave interactive material (metals) to the package to assist in the heating of a food product contained within the package.

Typically, in a microwavable food package having a microwave susceptor to assist in the heating of food within the package, a metal layer is applied to the package. More specifically, and as can be seen in the prior art U.S. Pat. No. 4,735,513, U.S. Pat. No. 4,553,010, U.S. Pat. No. 4,678,882, and U.S. Pat. No. 4,641,005, various types of containers for microwave usage incorporating heat susceptor material is shown. In most instances, if not all, the susceptor material, which is an electrically conductive material, such as a vapor deposition of metal onto a layer of the container, said conductive layer is integrated into the bag structure, and in most instances, is applied to an interior surface of the container, and in certain instances, either covered over by a laminar film, such as polymer film, or the metal layer is vacuum applied to the film, and then adhesively applied to the inner surface of the food container. Thus, on occasion, placing the metal in such close contact with the food product to be cooked has been undesirable, since frequently the metal layer when subjected to microwave energy has a tendency to fret, curl, or even peel, and if no interior protective layer is provided, can come into direct contact with the food product, or, may curl to the extent that it could rupture any overlying protective film, and still allow food contact with the metal film during microwaving. Such occurrences are undesirable. Because the metal layer is applied to the package containing the food, the metal layer is in close proximity to the food. When an uninterrupted or unbroken layer of metal is used as the susceptor, it alligators, or frets, or becomes crazed, as is shown in FIG. 1, when heated to high temperatures. This fretting can result after a relatively short time under microwave heating, i.e. in less than a minute. Hence, such undesirable features also can distort the relative time periods determined for heating or cooking of the particular packaged food, which may result in its undercooking, or overcooking, depending upon the extent of fretting that may have occurred. Thus, also, this condition can result in flaking of the metal from the bag, where spalling may occur at the metal edges, resulting in contamination of the food. To minimize this problem, the metal layer is often placed between two sheets of paper or the like which are held together with an adhesive compound, as shown is some prior art, as aforesaid. However, these adhesives, when heated to high temperatures in the microwave (temperatures as high as 400° F. can be reached when using metal layers) can cause undesirable emissions. Further, although the layers of the bag are considered to be transparent to microwaves, they are not. Even though the microwaves do pass through the substrates, there is a loss of energy and bending of the microwaves which reduce the effectiveness of the microwave energy. The adhesives used to secure the layers of the bag together absorb microwaves and cause a loss of energy and heating to the food product and may result in over heating, brown spots and possible emissions from the adhesive in harmful amounts.

SUMMARY OF THE INVENTION

One object of this invention is to provide a microwavable food package having a heat assist wherein the possibility of contamination of the food due to the breakdown of the metal susceptor or emissions from the adhesive is reduced, if not eliminated.

Another object of this invention is to provide an accessory for use in conjunction with a microwavable package, for use in assisting the heating of any material contained therein, such as food product or the like.

Another object of this invention is to provide such a microwavable package which is inexpensive and disposable.

A further object is to provide such a microwavable food package in which a maximum amount of microwave energy still reaches the food product in the package.

A further object of this invention is to provide a heat assist accessory for use in conjunction with a bag or container, and due to the unique combination of these components, lesser material, in the form of reduction of paper required for manufacture and assembly of the bag may be achieved.

A further object of this invention is a significant reduction in the amount of adhesive utilized in forming of microwavable bags, simply because the basic single ply bag may be used in conjunction with the heat assist accessory of the this invention, and achieve equivalent or more enhanced results.

A further object of this invention is to provide a heat assist accessory for use in conjunction with a microwavable bag, and because of its unique fabrication, achieves a reduction in the amount of waste paper or other ingredients used in the formation of the combination, and likewise, as a result thereof, has effected a reduction in labor during their manufacture and assembly.

Other objects of this invention will be apparent to those skilled in the art in light of the following description and accompanying drawings.

In accordance with the invention, generally stated, there is provided a microwavable package containing a food product. The package includes a standard container or bag which contains the food and a heat assist accessory which covers a face of the bag, but is remote from its interior. The accessory has a top, a bottom, and side edges. It is adhered to the bag only along two opposite edges, preferably the side edges. Although, it is possible to adhere a bottom or top edge to the container and still obtain the desired results of this invention. The accessory is made from a one-ply of paper having a metalized film laminated thereon. Alternatively, a polymer film may serve as the one-ply. The metallization covers a full or partial surface of the accessory. In the preferred embodiment, a pattern of metal free areas is formed in the metallization which resembles expansion breaks, to prevent the break-up of an unbroken metallic layer when such a metallic layer is heated by exposure to microwaves. The pattern is made of a plurality of rows of slots, or other designs, such as the S's which are formed in two or more directions. The pattern may also be formed as a thin, tight or minuscule grid.

DESCRIPTION OF THE PREFERRED EMBODIMENT

Figure 1:
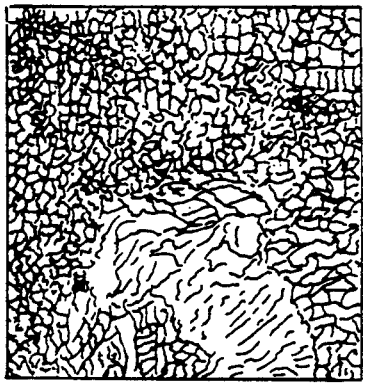
FIG. 1 is a plan view of the prior art of a metalized substrate after it has been heated by exposure to microwaves.

Prior art microwavable bags commonly have an uninterrupted or unbroken layer of metal applied to selected portions thereof. As can be seen in FIG. 1, after the metal is exposed to microwaves, it undertakes a crazed texture. This can lead to flaking or spalling of the metal layers, as aforesaid, and possible contamination of the food in the bag.

Figure 2:
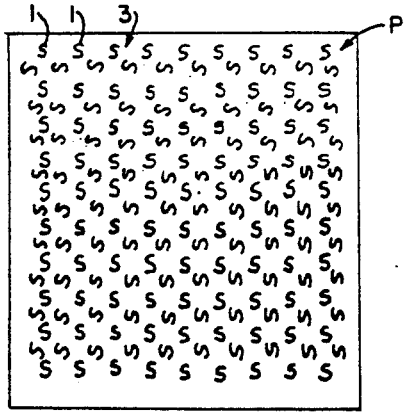
FIG. 2 is a plan view of a metalized substrate with a pattern formed thereon.

If a thin line pattern of metal free areas is formed in the metal layer which simulates the fretting of the metal due to heating, break-up and subsequent flaking of the metal is greatly reduced. Referring to FIG. 2, the pattern P of metal free areas is formed as a series of S's 1 which are formed as rows 3 in the metal M. The pattern is formed over the complete metalized area. The rows of S's may be formed in multiple directions. In FIG. 2, horizontal and vertical rows of S's are shown, i.e. the S's are formed at right angles to each other. However, it has been found that the S's could be formed in a single direction, or in more than two directions, i.e. in diagonals to the vertical and horizontal. The S's are about 5/64" to about 7/64", preferably about 3/32", in height. The S's are separated by about ⅛"-9/64". The rows 1 are separated by about 15/64" and the vertical rows are separated from the horizontal rows by about 3/32".

The pattern may be formed by a demetallization process such as is disclosed in our co-pending application, Ser. No. 195,256, filed May 18, 1988, and now abandoned, or in our U.S. Pat. No. 4,941,865, each of which are incorporated herein by reference. The pattern can also be formed in other ways, such as by printing the metal on the substrate with the pattern, or by using a mask, metalizing the masked substrate, and rinsing the metalized substrate to remove the metal in the masked areas, to provide the gridwork for expansion to relieve stress and eventual crazing of the metal, such as can be avoided through the array of S designs. The metalized film, as prepared, can be manufactured in roll form and marketed for application in that manner.

Figure 3:
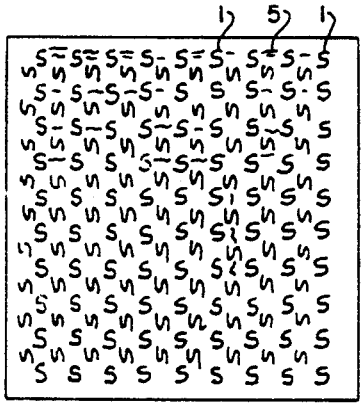
FIG. 3 is a plan view of the metalized substrate of FIG. 2 after heating by exposure to microwaves.

When the patterned metal is heated by exposure to microwaves, very little fretting occurs. As is seen in FIG. 3, the S's become joined, at the most, by small cracks 5 in the metal. These cracks, however, have not been found to be sufficient to lead to flaking of the metal layer. Because there is no flaking of the metal layer, the possibility of contamination of the food product is greatly reduced.

Figure 4:
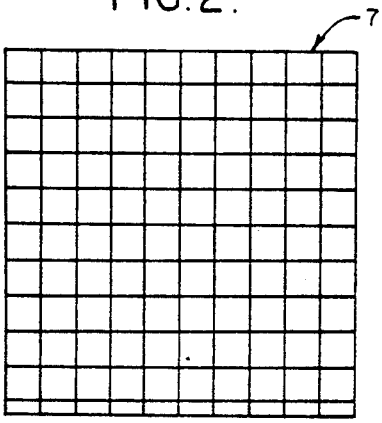
FIG. 4 is a view similar to FIG. 2 showing an alternate pattern of metal formed on the substrate.

The pattern can also be formed as a tight grid 7. This grid 7, like the S pattern, is formed over the entire metalized area. (FIG. 4). This provides thin lines of demetalized or unmetallized areas throughout the thin metal surfaces. Obviously, other pattern designs can be utilized to achieve the desired results of this invention.

Figure 5:
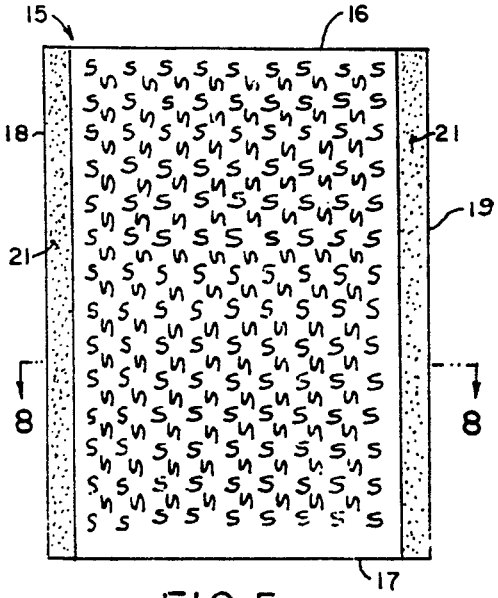
FIG. 5 is a plan view of a heat assist accessory for use with a microwavable bag.
Figure 8:
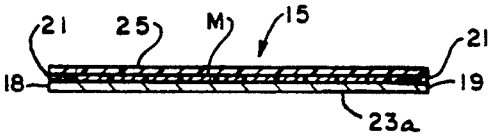
FIG. 8 is a cross-sectional view of the heat assist accessory.
Figure 6:
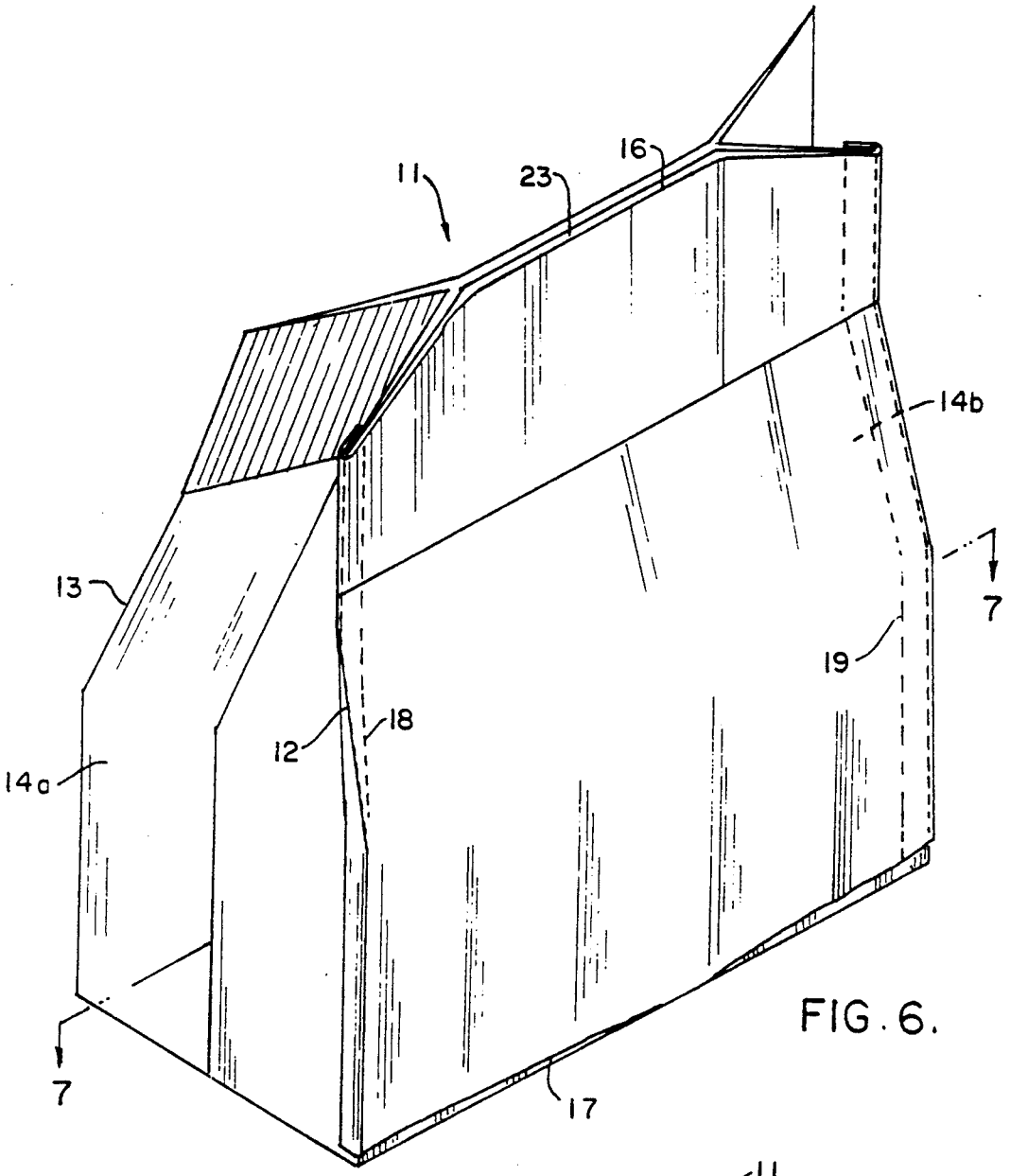
FIG. 6 is an isometric view of a container showing the application of the heat assist accessory applied thereto.
Figure 7:
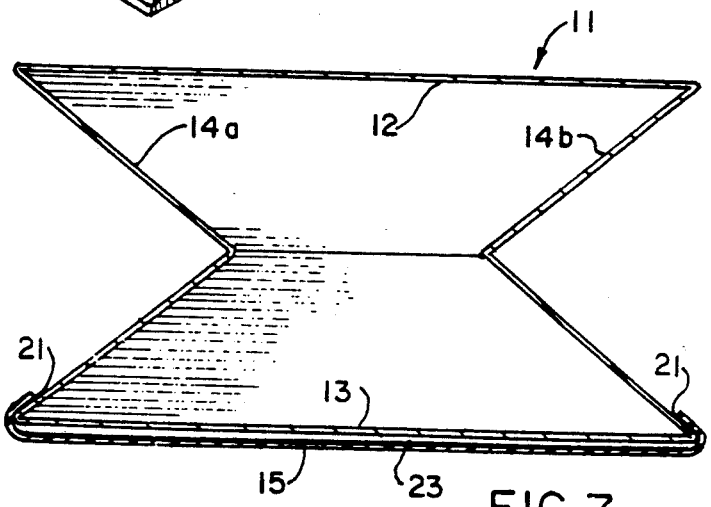
FIG. 7 is a cross-sectional view of a microwavable bag with the heat assist accessory thereon, as shown along the line 7-7 of FIG. 6.

To form the microwavable bag, a standard one-ply bag 11 having faces 12 and 13 and gusseted sides 14*a* and 14*b*, such as a standard form-and-fill preformed bag, is used. See FIGS. 5, 6, and 7. By using a one-ply bag, the use of adhesive needed in forming two- and three-ply bags is avoided. The bag is treated with a coating, such as FC807 Anti Grease Coating available from 3M Company, which will enable the bag to withstand the oil and grease in the food, particularly when popcorn is involved. The bag itself is desirably not metallized. Although, the concept of this invention incorporating patterned designs can be incorporated into the type of metallized bag and containers as shown in the prior art, and still have desirable results.

To obtain the desired heat assist, an accessory 15 is added to one of the faces 12 and 13 of bag 11. It is added as a form of supplemental bag or wall sleeve. Accessory 15 has a top edge 16, a bottom edge 17, and side edges 18 and 19. The accessory 15 is separated from the bag 11 except for two lines 21 of heat resistant adhesives such as Electromek WA4849 or Elite #71 available from Electromek Company, of Carlstadt, N.J. Adhesive lines 21 are formed along the side edges 18 and 19 of the accessory. The adhesive is preferably applied as a strip having a width of about 1/16" or less. Because the accessory is adhered to the bag only along two edges thereof, a gap 23 may exist between the bag 11 and the heat assist accessory 15, throughout their heighth. Gap 23, however, is not large enough to affect the energy which radiates from the metal layer to assist in the heating of the food product in bag 11. The metal layer normally will be located upon the inner or bag contiguous surface of the accessory 15, leaving its outer and exposed surface for other usage, such as for containing print material.

The accessory is preferably made from a layer of paper 23*a* such as Rhinelander 30# MF Paper having a layer of metalized M, PET film 25 laminated thereto. Film 25 is laminated to the paper layer using the same high heat resistant adhesives used to secure the accessory to the bag. The adhesive preferably is applied over the entire surface of the interface between the paper layer and the film 25. In the alternative, the adhesive may be patterned applied so that only select portions of this combination will be connected. The PET film is metalized to an optical density of about 0.22–0.28. This may comprise a layer of metal and prefereably the metal surface M will be between the PET film 25 and the accessory layer of paper or the like 23*a*. The accessory is fully metalized with the pattern of FIGS. 2 or 4, or the like, of a micron or more thickness.

The accessory is preferably fully coextensive with the face 12 or 13 to which it is secured. Although patterned applications may be effective. The blank from which the accessory is formed may be slightly wider than the bag face 11 so that the side edges 18 and 19 of accessory 15 can be folded around the vertical edges of the bag 11 to be adhered to the gusseted sides 14*a,b* of bag 11. See FIGS. 6 and 7.

The heat assist is completely free and separate from the bag throughout is height, in the preferred embodiment. On the other hand, if desired, to fully integrate the accessory into the construction of the bag, in the modification, the bottom edge 17 may be likewise adhesively secured to the lower edge of the container 11, such as along the bottom edge 17 of the said accessory. Furthermore, it is just as likely that the accessory could be adhesively secured along its upper edge 16, to the bag 11, while the sides of the accessory may be free and open, to form a sleeve-like configuration with the said bag. The purpose for this is that applying the accessory, as just that, to the bag, reasonably separate from the integrated structure of the bag itself, the heat assist susceptor of metal is totally separated from any contents of the bag, and completely eliminates the possiblity of any metal, in flake form, being exposed to the food or other product contents of the bag being subject to microwaving. On the other hand, as previously explained, the concept of this invention, which is to provide a form of means of expansion to the metal heat assist, by providing minuscule areas of potential expansion, as has been determined, can be integrated into the bag structure per se, in the manner as shown in the variety of prior art bags and containers that have previously been patented.

In view of the structure of this invention, and the assembly of the container or bag 11 with the addition of the accessory of this development, the package is generally free of adhesive, except along whatever manufacturer's joint may be embodied within the structure of the bag, and for those marginal edges that apply this accessory to the container. The heat assist is able to provide a maximum safe thermal penetration of the microwave energy without breaking up. This is because normally it will completely cover the surface of the accessory, except for the expansion areas, as previously explained, and is provided over the entire surface of the container holding the food or other product to be microwaved. Overall, an even heating is thus provided to the container contents As previously explained, it may be that the metal surface of the accessory may be located only at isolated points along the surface of the said accessory 15, to provide focal heating, where desired The package is free of adhesive and the heat assist is able to provide a maximum safe thermal penetration from the microwave energy without breaking up. Because it completely covers the surface of the accessory, overall even heating is attained.

Numerous variations, within the scope of the appended claims, will be apparent to those skilled in the art in light of the foregoing description and accompanying drawings. For example, as previously explained, the heat assist accessory could be secured to the face 12 or 13 of bag 11 along the top and bottom edges of the accessory. This would still leave the sleeved relationship, either in the form of a gap, or contiguousness, between the bag and the accessory. The metal layer with the pattern of FIGS. 2 or 4, or to other related and effective designs, could also be formed between layers of a two-ply bag. Although, this however, is not the preferred embodiment because it brings the metal layer into closer proximity to the food product contained within the bag, but nevertheless, it is an alternative. These examples are merely illustrative.

Having thus described the invention, what is claimed and desired to be secured by Letters Patent is:

1. A microwable package containing a food product, said package comprising a bag formed of a series of walls including a front, back, and a bottom wall, said entire bag being formed of a single-ply paper, a heat assist accessory applied to and covering the exterior of one of said front and back wall of said bag, said accessory having a top, bottom, and side edges, said accessory being adhered to one of said front and back wall only along two select opposite edges of said accessory, the remainder of said heat assist accessory being unconnected with either said front or back wall of said bag, said accessory having a metallized surface thereon sufficient to generate heat and provide heat assist to the contents of the package during microwaving, said accessory formed of a single-ply paper, a polymer film having a metallized surface applied thereon adhered to said single-ply of paper forming said accessory, and a high heat resistant adhesive securing the film to the paper ply forming the accessory, such that upon microwaving of the package containing said food product, the heat resistant adhesive securing the accessory provides dimensional stability to the said film forming the accessory and preventing a delamination and break-up of the accessory and its metallized film when exposed to any microwave energy.

2. The package of claim 1 wherein said surface of said accessory is fully metallized.

3. The package of claim 1 wherein said surface of said accessory is partially metallized.

4. The package of claim 3 and wherein a pattern of metal free areas is formed in said metallization, said pattern being formed to assimilate the break-up of an unbroken metallic layer which has been heated to high temperatures.

5. The package of claim 4 wherein said pattern comprises a plurality of rows of S's which cover said metal layer.

6. The package of claim 5 wherein said rows of S's are formed in at least two directions.

7. The package of claim 4 wherein said pattern is a grid of metal free spaces.

8. The package of claim 7 and wherein said metal free spaces comprise metal free lines provided in the metal layer.

9. The package of claim 4 wherein said bag is a microwavable popcorn popping container.

10. The package of claim 9 wherein said polymer film having the metallized surface being a polyethylene terephthalate, and said heat resistant adhesive securing the metallized film to the paper ply being a vinyl ethylene acetate copolymer adhesive.

11. The package of claim 1 wherein said heat assist accessory comprises a combination of polymer layer and paper layer with said metallized film attached therebetween.

12. The package of claim 1 and including an adhesive adhering the accessory to the bag along said two opposite edges, and there being a void of adhesive between the accessory and the bag at the location of the metallized surface.

13. The package of claim 1 and wherein said single-ply paper forming said bag having a grease resistant coating applied thereto.

* * * * *